US007954352B2

(12) United States Patent
Allen et al.

(10) Patent No.: US 7,954,352 B2
(45) **Date of Patent: *Jun. 7, 2011**

(54) SHEET METAL BENDING BRAKE

(75) Inventors: Clyde G. Allen, Lapeer, MI (US); Todd M. Lajewski, Lapeer, MI (US); Douglas Break, Livonia, MI (US)

(73) Assignee: Tapco International Corporation, Wixom, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/708,402

(22) Filed: Feb. 18, 2010

(65) Prior Publication Data

US 2010/0147046 A1 Jun. 17, 2010

Related U.S. Application Data

(63) Continuation of application No. 12/051,376, filed on Mar. 19, 2008, now Pat. No. 7,685,858, which is a continuation of application No. 11/262,631, filed on Oct. 31, 2005, now abandoned.

(60) Provisional application No. 60/623,468, filed on Oct. 29, 2004.

(51) Int. Cl.
*B21D 11/00* (2006.01)

(52) U.S. Cl. ..... 72/319

(58) Field of Classification Search ..... 72/319, 72/320–323, 387, 388

See application file for complete search history.

(56) References Cited

U.S. PATENT DOCUMENTS

| | | | |
|---|---|---|---|
| 3,817,075 | A | 6/1974 | Marsh et al. |
| 3,877,279 | A | 4/1975 | Van Cleave |
| 4,081,986 | A | 4/1978 | Break |
| 4,092,841 | A | 6/1978 | Chambers, Jr. |
| 4,240,279 | A | 12/1980 | Rhoades |
| 4,282,735 | A | 8/1981 | Break |
| 4,321,817 | A | 3/1982 | Barnack |
| 4,364,254 | A | 12/1982 | Chubb et al. |
| 4,372,142 | A | 2/1983 | Rhoades |
| 4,445,356 | A | 5/1984 | Chubb et al. |
| 4,489,583 | A | 12/1984 | Rhoades |
| 4,493,200 | A | 1/1985 | Rhoades |
| 4,494,397 | A | 1/1985 | Rhoades |
| 4,512,174 | A | 4/1985 | Rhoades |
| RE31,938 | E | 7/1985 | Klukow |
| 4,557,132 | A | 12/1985 | Break |

(Continued)

FOREIGN PATENT DOCUMENTS

WO 2005049243 A2 6/2005

*Primary Examiner* — Debra M Sullivan

(74) *Attorney, Agent, or Firm* — Howard & Howard Attorneys PLLC

(57) ABSTRACT

A bending brake assembly for manually bending pieces of sheet metal material including a base supporting a plurality of c-shaped members presenting opposing clamping surfaces for receiving the sheet metal material. An extension extends away from the clamping surfaces with a socket connection rotatably supporting a bending member on the base for bending the sheet metal material disposed between the clamping surfaces. The socket connection includes a male portion and a female portion in sliding engagement with one another as the bending member moves between a pre-bending position, a first operating position, and a second operating position. A finger extends from the male portion and defines a gap between the finger and the extension when in the pre-bending position with the finger maintaining the gap as the finger moves from the pre-bending position to the first operating position and the finger engaging the extension when in the second operating position.

40 Claims, 8 Drawing Sheets

U.S. PATENT DOCUMENTS

| | | | |
|---|---|---|---|
| 4,566,304 | A | 1/1986 | Van Cleave et al. |
| 4,592,518 | A | 6/1986 | Chubb et al. |
| 4,651,553 | A | 3/1987 | Rhoades |
| 4,671,094 | A | 6/1987 | Break |
| 4,766,757 | A | 8/1988 | Break et al. |
| 5,343,728 | A | 9/1994 | Chubb et al. |
| 5,353,620 | A | 10/1994 | Olsen et al. |
| 5,505,069 | A | 4/1996 | Break et al. |
| 5,582,053 | A | 12/1996 | Chubb et al. |
| 5,582,055 | A | 12/1996 | Chubb et al. |
| 5,706,692 | A | 1/1998 | Chubb et al. |
| 5,706,693 | A | 1/1998 | Chubb et al. |
| 5,743,129 | A | 4/1998 | Chubb et al. |
| 5,761,939 | A | 6/1998 | Spencer et al. |
| 5,992,203 | A | 11/1999 | Chubb et al. |
| 6,003,357 | A | 12/1999 | Brown |
| 6,085,569 | A | 7/2000 | Chubb et al. |
| 6,389,864 | B1 | 5/2002 | Chubb et al. |
| 6,571,594 | B2 | 6/2003 | Clark |
| 6,675,619 | B2 | 1/2004 | Clark |
| 6,802,198 | B2 | 10/2004 | Clark |
| 6,901,783 | B2 | 6/2005 | Clark |
| 6,941,788 | B2 | 9/2005 | Goubaud |
| 7,043,950 | B2 | 5/2006 | Clark et al. |
| 7,117,705 | B2 | 10/2006 | Clark |
| 7,191,631 | B2 | 3/2007 | Break |
| 7,228,721 | B2 | 6/2007 | Clark |
| 2002/0124621 | A1 | 9/2002 | Clark |
| 2003/0084698 | A1 | 5/2003 | Clark |
| 2004/0099034 | A1 | 5/2004 | Clark |
| 2005/0103081 | A1 | 5/2005 | Break |
| 2005/0150269 | A1 | 7/2005 | Clark |
| 2007/0175257 | A1 | 8/2007 | Break |
| 2007/0277577 | A1 | 12/2007 | Allen et al. |
| 2008/0034828 | A1 | 2/2008 | Clark |
| 2008/0223103 | A1 | 9/2008 | Allen et al. |

SHEET METAL BENDING BRAKE

CROSS REFERENCE TO RELATED APPLICATION

This application is a Continuation of U.S. Non-Provisional patent application Ser. No. 12/051,376 filed on Mar. 19, 2008, which is now U.S. Pat. No. 7,685,858, which is a Continuation of U.S. Non-Provisional patent application Ser. No. 11/262,631 filed on Oct. 31, 2005, which is now abandoned, which claims the benefit of U.S Provisional Patent Application Ser. No. 60/623,468, filed Oct. 29, 2004, in which all contents are incorporated herein in their entirety.

BACKGROUND OF THE INVENTION

1. Field of the Invention

The subject invention relates to a bending brake assembly for manually bending pieces of sheet metal material.

2. Description of the Prior Art

A bending brake assembly generally includes a base and a plurality of generally c-shaped members supported by the base and each presenting opposing clamping surfaces for receiving a sheet of metal material between the clamping surfaces. Furthermore, the assembly generally includes a bending member and a socket connection rotatably supporting the bending member on the base for bending a piece of sheet metal material disposed between the clamping surfaces. The socket connection generally includes a male portion and a female portion in sliding engagement with one another or connected by a pin hinge connection to one another. Examples of bending brake assemblies and socket connections as specified are shown in U.S. Pat. No. 4,282,735, issued to Douglas G. Break and in U.S. Pat. No. 6,389,864, issued to Arthur B. Chubb. Further, U.S. Pat. No. 4,282,735 discloses a finger in constant engagement with an extension as the bending member rotates to bend the sheet metal material. The effort required to rotate the bending member is greater than other designs due to the constant engagement between the finger and the extension. Also, a portion of the bending member abuts and moves along the sheet metal material as the bending member rotates to bend the sheet metal material, which may cause marring of the sheet metal material. Another example is U.S. Pat. No. 4,557,132 issued to Douglas G. Break which discloses a bending brake assembly including a base having a plurality of projections spaced from each other and disposed along a length of the bending brake assembly. Each of the projections of the base define a slot for receiving a pin. The bending brake assembly further includes a bending member having a plurality of projections spaced from each other with each of the projections of the bending member defining an opening. Each of the projections of the bending member is disposed between a pair of adjacent projections of the base such that the pin is disposed through the slot and the opening of each of the projections of the base and the bending member for coupling the bending member to the base to allow movement of the bending member relative to the base. However, each of the projections and the opening of the bending member and each of the projections and the slot of the base are formed by machining which is expensive and time consuming to manufacture.

Constant and continuous usage of the bending brake assembly causes the male portion to erode due to the frictional force generated by the surface of the male portion sliding against the surface of the female portion during the process of bending a piece of sheet metal material.

SUMMARY OF THE INVENTION AND ADVANTAGES

The present invention provides such a bending brake assembly including a bearing strip being sandwiched between a male portion and a female portion for facilitating relative movement between the male portion and the female portion. The present invention further provides for an extension extending from a base and a finger extending from the male portion and defining a gap between the finger and the extension when in a pre-bending position with the finger maintaining the gap as the finger moves from the pre-bending position to a first operating position and the finger engaging the extension when in a second operating position for reducing an amount of effort to elevate a bending member and for improving a precision of bending a sheet metal material. In addition, the male portion contacts the sheet metal material in substantially a same relative position of contact during movement from the pre-bending position to the first and second operating positions which aids in minimizing marring of the sheet metal material. Additionally, the finger and the extension design eliminates having to machine some of the components as required in the prior art design as discussed above.

The bearing strip minimizes the erosion of the male portion due to the frictional force generated by the surface of the male portion sliding against the surface of the female portion during the process of bending a piece of sheet metal material.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Figure 1:
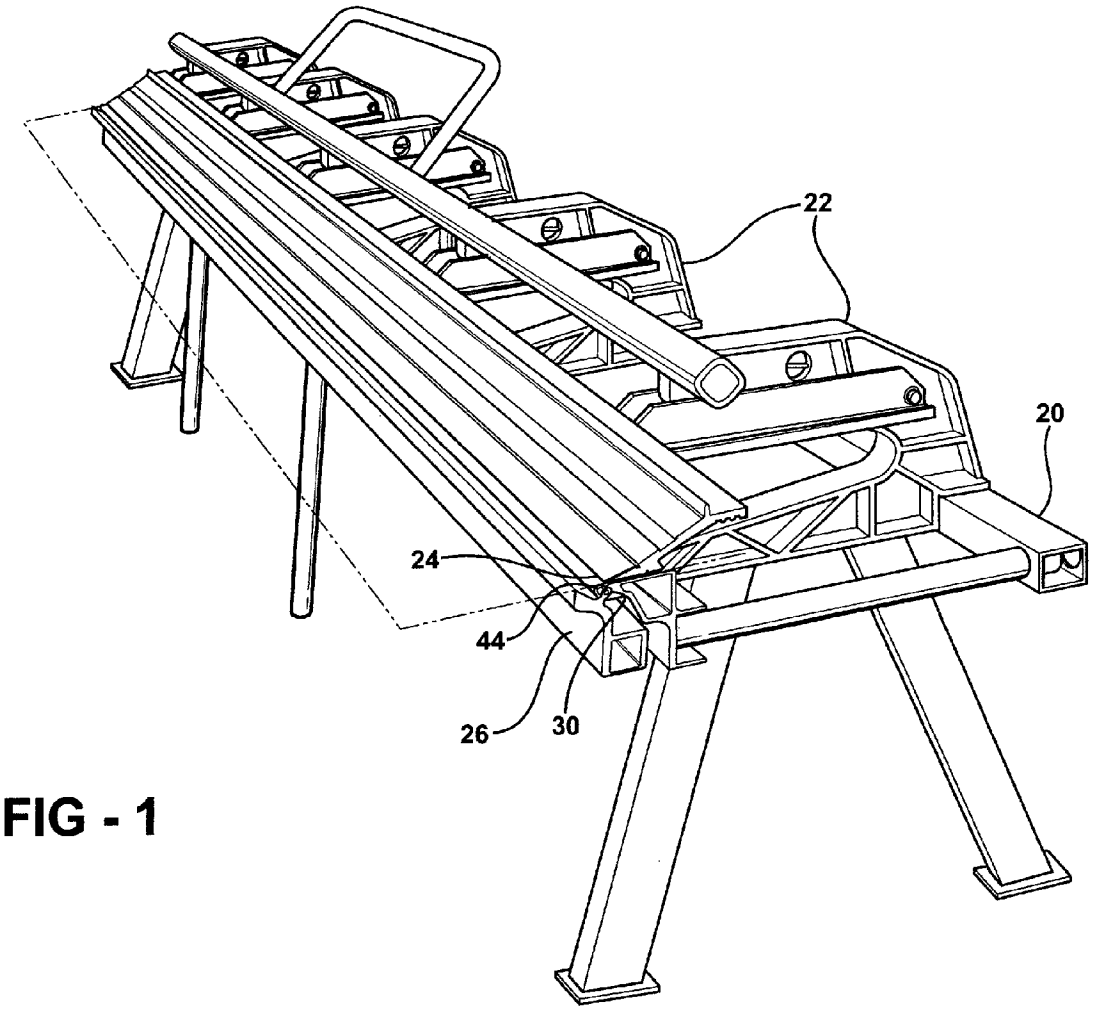
FIG. 1 is a perspective view of a sheet bending brake assembly embodying the invention.
Figure 2:
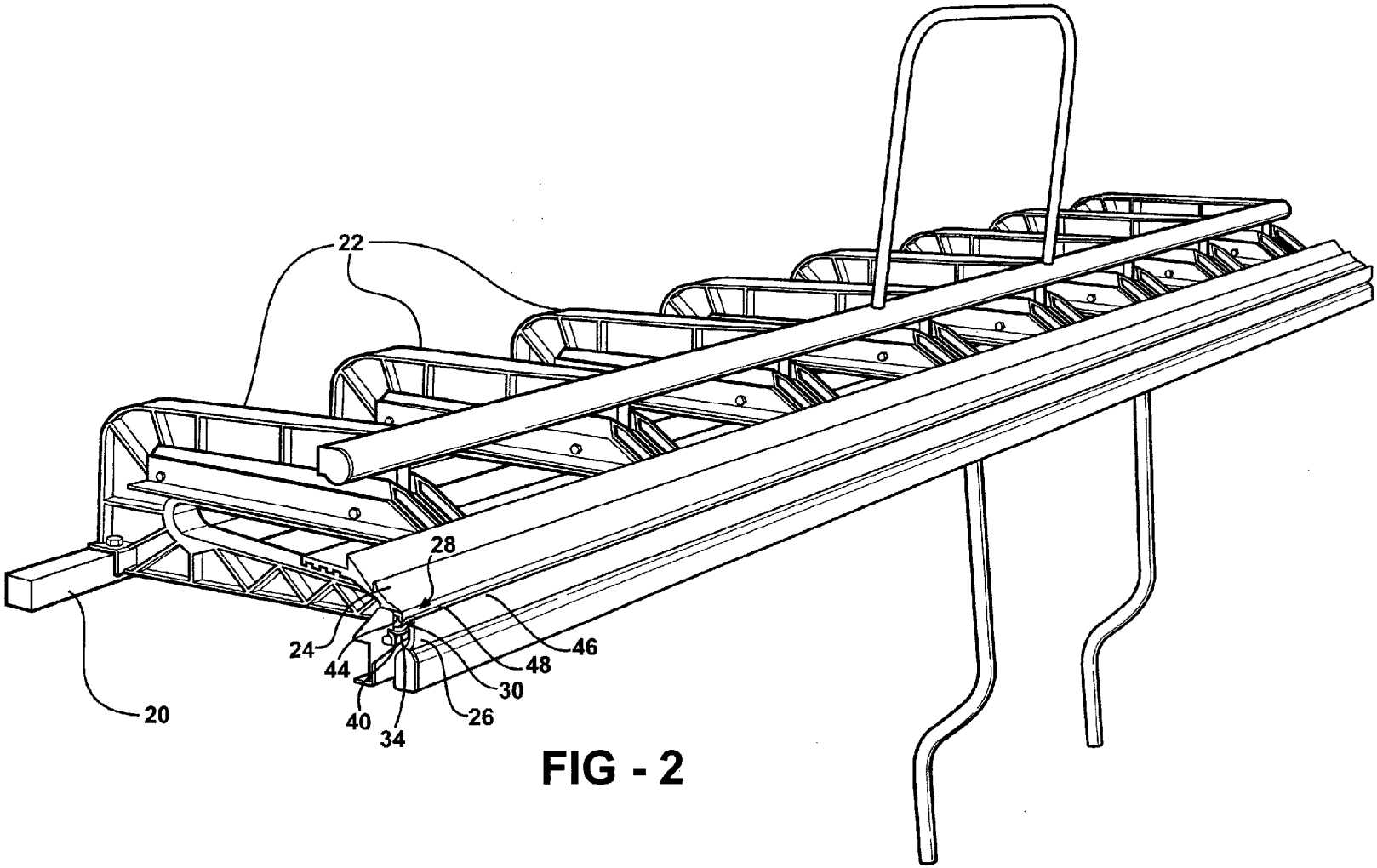
FIG. 2 is a perspective view of a base of the present invention.
Figure 3:
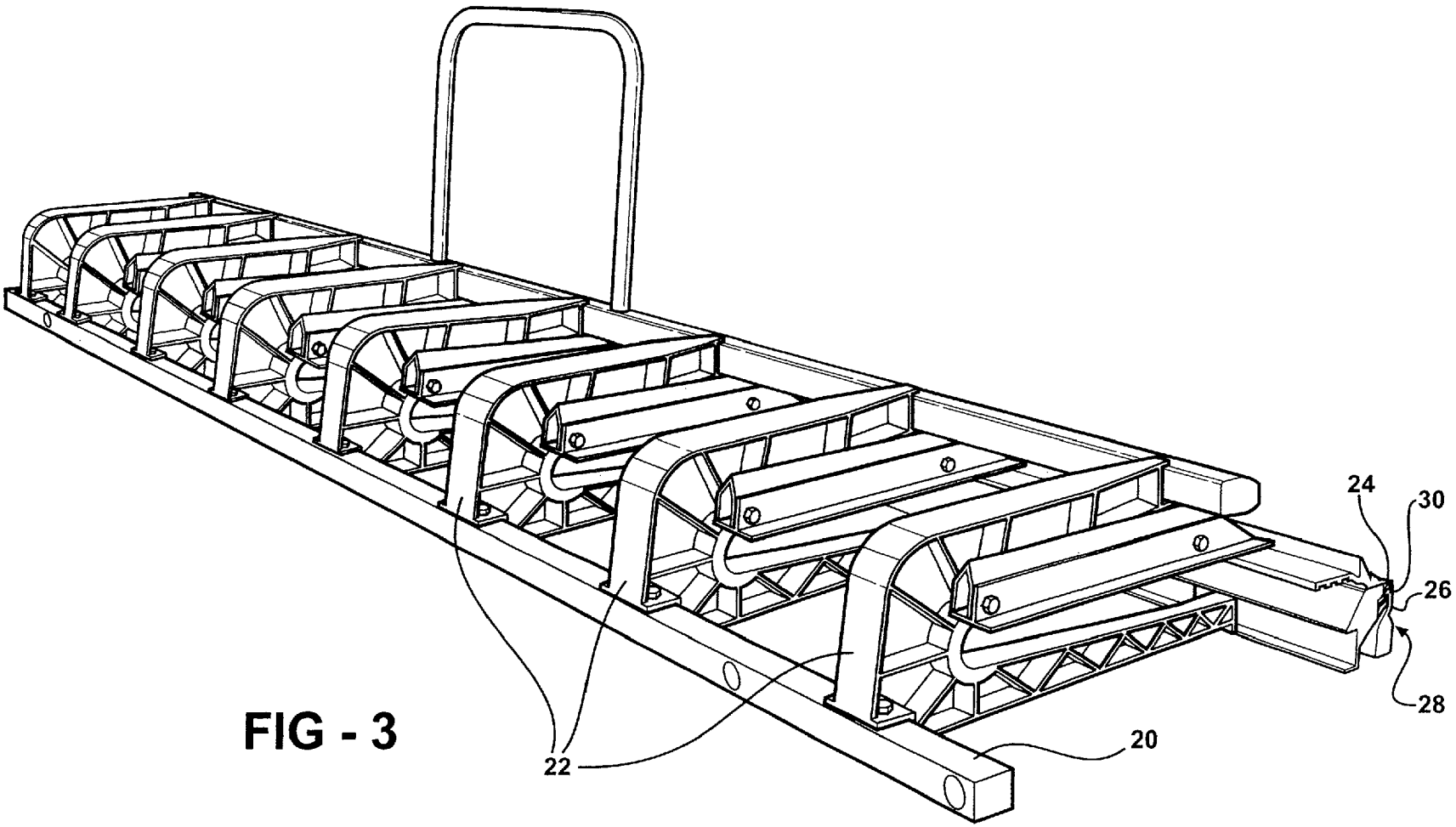
FIG. 3 is an alternative perspective view of the base shown in FIG. 2.
Figure 4:
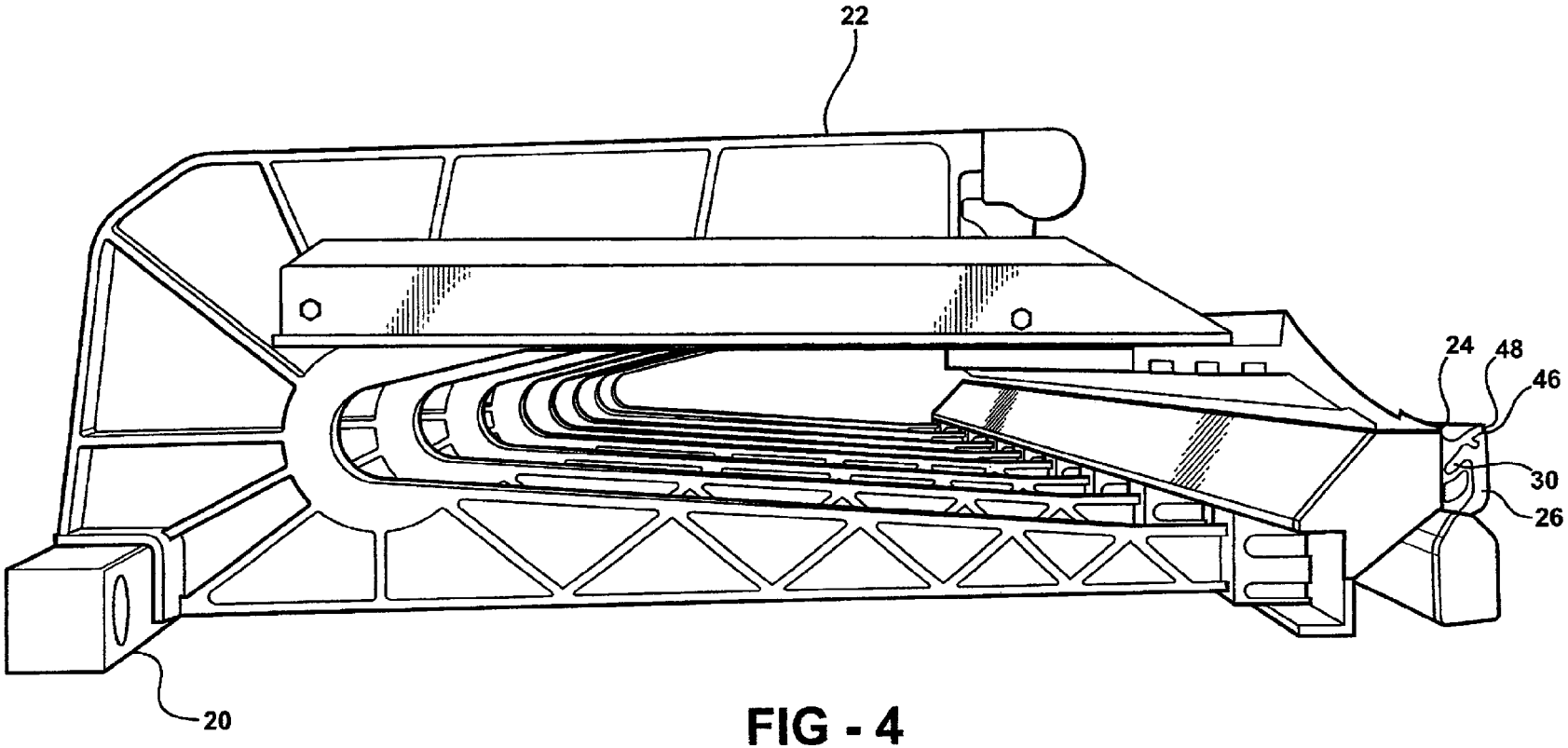
FIG. 4 is a vertical sectional view of the sheet bending brake assembly.
Figure 5:
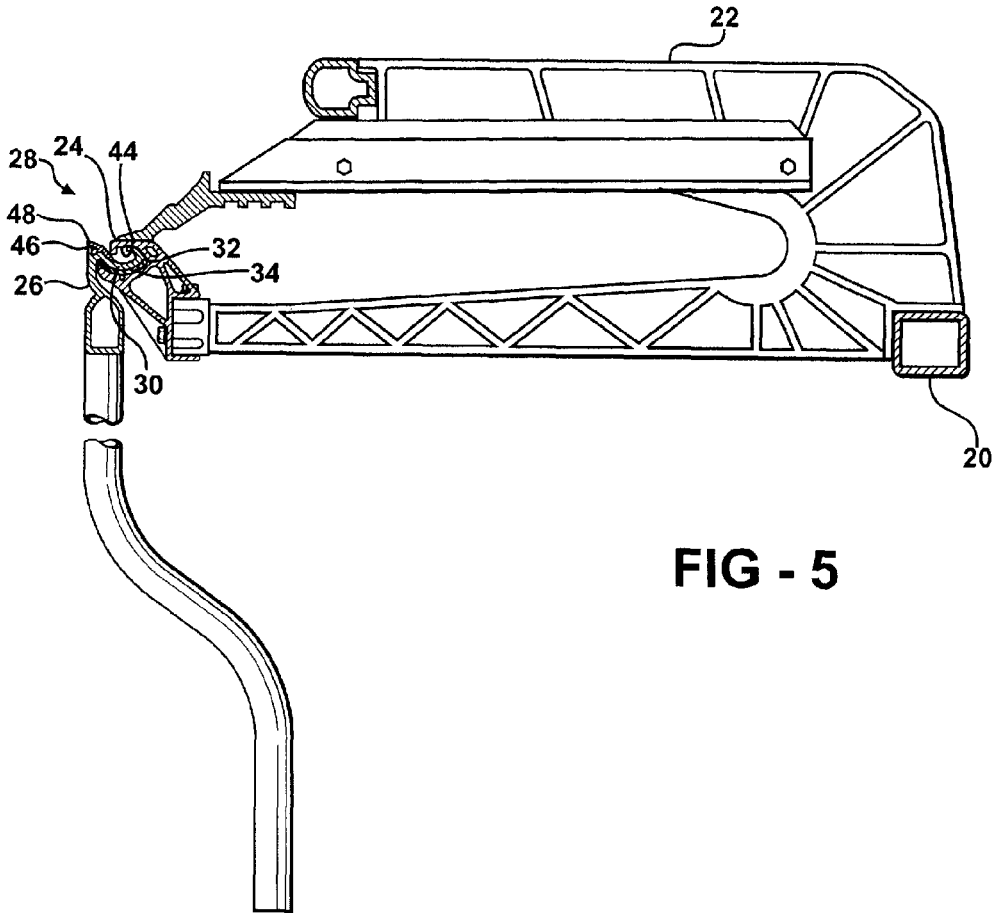
FIG. 5 is an alternative vertical sectional view of the sheet bending brake assembly.
Figure 6:
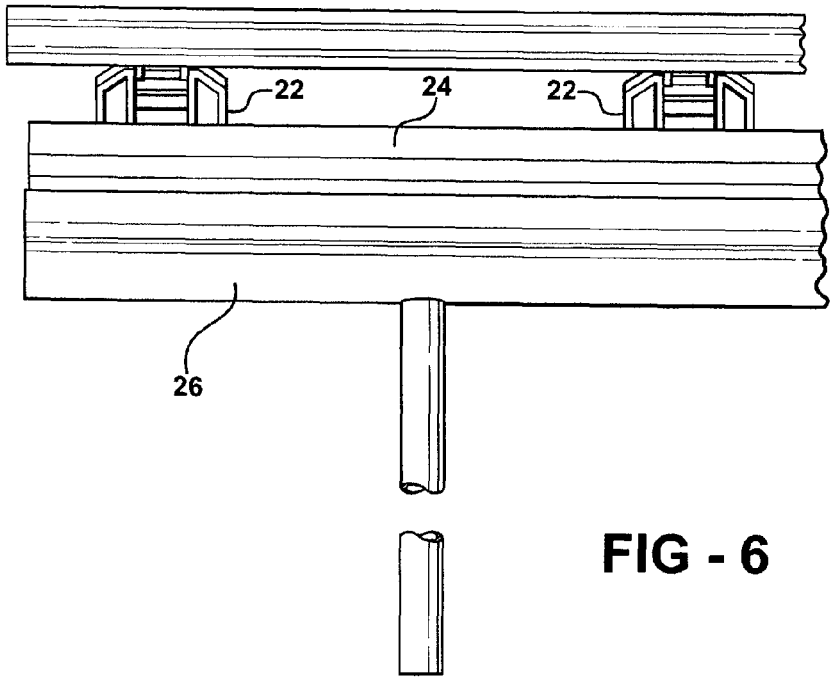
FIG. 6 is a front view of the sheet bending brake assembly.
Figure 7:
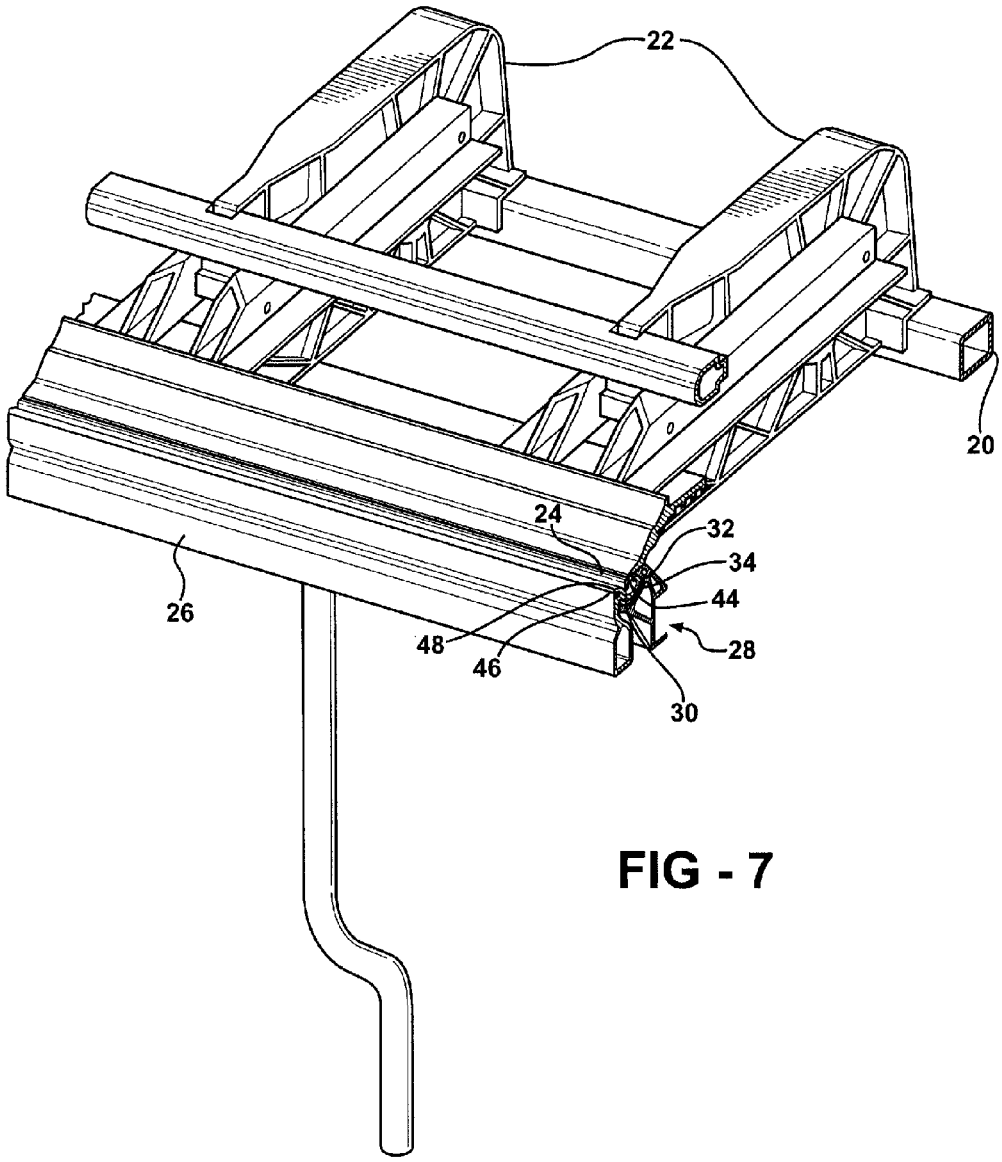
FIG. 7 is an alternative perspective view of the sheet bending brake assembly.
Figure 8:
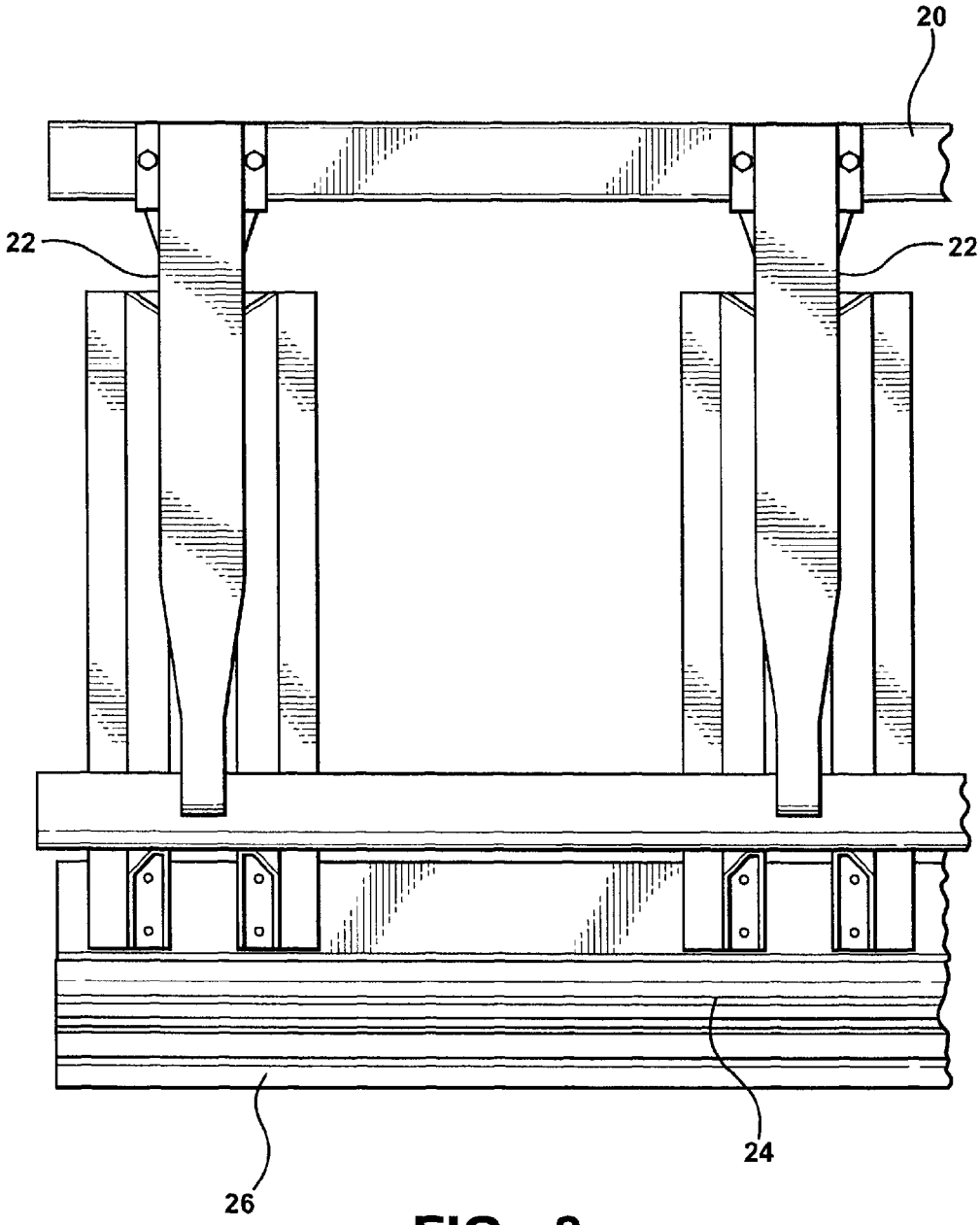
FIG. 8 is a top plan view of the sheet bending brake assembly.

Referring to the Figures, wherein like numerals indicate corresponding parts throughout the several views, a bending brake assembly for manually bending pieces of sheet metal material is shown including a base (20). A plurality of generally c-shaped members (22) are supported by the base (20) and each c-shaped member (22) presents opposing clamping surfaces (24) for receiving a sheet metal material between the clamping surfaces (24). An extension (60) extends from the base (20) away from the clamping surfaces (24) to a distal end surface (62).

The bending brake assembly also includes a bending member (26). A socket connection (28) rotatably supports the bending member (26) on the base (20) for bending a piece of sheet metal material disposed between the clamping surfaces (24). The socket connection (28) includes a male portion (30) and a female portion (32) in sliding engagement with one another.

The bending brake assembly includes a bearing strip (34) being sandwiched between the male portion (30) and the female portion (32) for facilitating relative movement between the male portion (30) and the female portion (32). The bearing strip (34) minimizes the erosion of the male portion (30) which occurs due to the frictional force exerted on the male portion (30) when the male portion (30) slides against the female portion (32) due to the bending member (26) being used to bend sheet metal material.

The bending brake assembly also includes a first mechanical connection (36) that connects the bearing strip (34) to one of the male portion (30) and the female portion (32). The first mechanical connection (36) includes a projection (38) and a recess (40) for securing the bearing strip (34) to one of the portions (30, 32).

The female portion (32) and the male portion (30) are arcuate and the bearing strip (34) is arcuate and complementary to the portions (30, 32). The male portion (30) presents an arcuate upper surface (42) and the base (20) includes an inner surface (64) defining a pocket (44) with the arcuate upper surface (42) engaging the inner surface (64). The pocket (44) defines a fulcrum engaging the upper surface (42) of the male portion (30) for guiding arcuate movement of the bending member (26) as the arcuate male portion (30) slides along the bearing strip (34).

The male portion (30) is configured for applying force to a sheet metal material so that the sheet metal material can be bent with precision and accuracy. The configuration entails the male portion (30) presenting a slanted corner (46) for bending the sheet metal material. The slanted corner (46) permits direct force to be applied to the sheet metal material at a particular location.

A rubber strip (48) is secured to the slanted corner (46) and abut the extension (60) when in a pre-bending position for preventing damage to the sheet metal material as the bending member (26) moves between a first operating position and a second operating position. In operation the bending member (26) is raised which causes the rubber strip (48) secured to the slanted corner (46) to directly contact the sheet metal material. The rubber strip (48) prevents the possibility of slippage by the bending member (26) once it contacts the sheet metal material. The rubber strip (48) also prevents the sheet metal material from being marred by scratches and dents which could occur if the bending member (26) directly contacted the sheet metal material during the bending process. Both the bending member (26) and the sheet metal material are formed of metal properties which make it likely that the sheet metal material could be damaged by impact of the two metals contacting each other directly during the bending process.

A second mechanical connection (50) secures the rubber strip (48) to the male portion (30). The second mechanical connection (50) includes a protrusion (52) and a nook (54) for securing the rubber strip (48) to the male portion (30).

Figure 9:
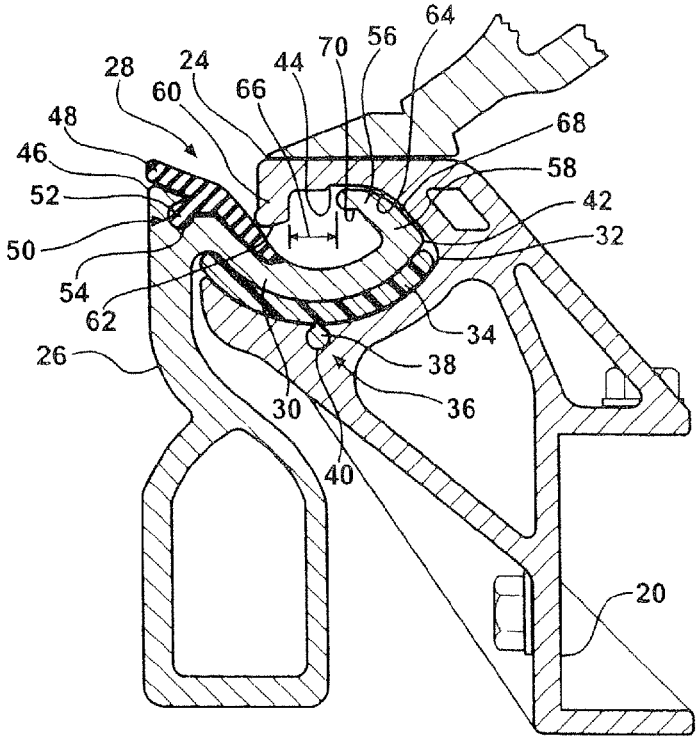
FIG. 9 is a perspective view of a socket connection of the present invention.
Figure 10:
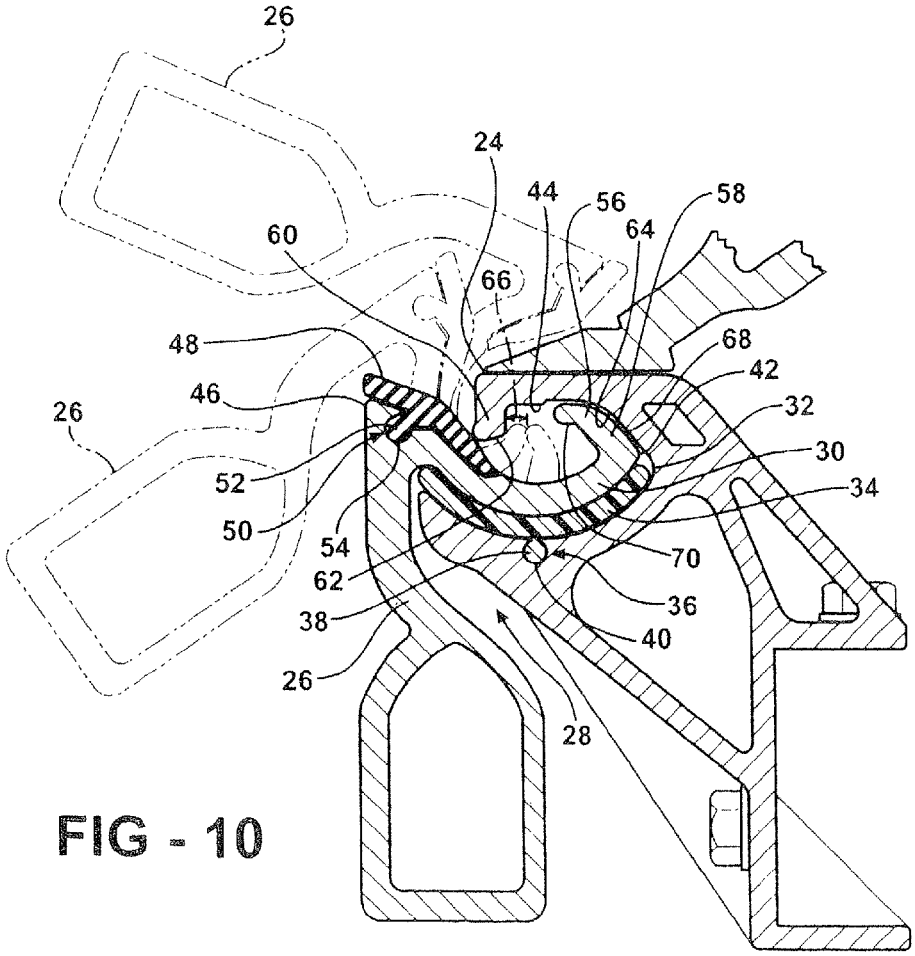
FIG. 10 is an operational perspective view of the socket connection shown in FIG. 9.

A finger (56) extends from a distal end (58) of the male portion (30) for engaging the pocket (44) to limit movement of the male portion (30) into the pocket (44) in the pre-bending position of the bending member (26). The finger (56) extends from the male portion (30) and defines a gap (66) between the finger (56) and the extension (60) when in the pre-bending position. The finger (56) maintains the gap (66) as the finger (56) moves from the pre-bending position to the first operating position and the finger (56) engages the extension (60) when in the second operating position for reducing an amount of effort to elevate the bending member (26) and for improving a precision of bending the sheet metal material. Referring to FIGS. 9 and 10, the bending member (26) is shown in the pre-bending position in solid lines. Further, as shown in phantom lines in FIG. 10, the bending member (26) is shown in the first and second operating positions. The gap (66) reduces in size as the distal end (58) and the finger (56) move from the pre-bending position to the first operating position. The finger (56) and the distal end (58) further include an outer surface (68) abutting the inner surface (64) of the base (20) when in the pre-bending position with the outer surface (68) spaced from the inner surface (64) when in the first and second operating positions. The finger (56) also behaves as a stop for the male portion (30) by ensuring that the male portion (30) does not disengage from the female portion (32) during the bending process wherein the bending member (26) is elevated. More specifically, the finger (56) includes an engagement surface (70) configured to complement the distal end surface (62) for maintaining engagement between the finger (56) and the extension (60) when in the second operating position.

Obviously, many modifications and variations of the present invention are possible in light of the above teachings. The invention may be practiced otherwise than as specifically described within the scope of the appended claims, wherein that which is prior art is antecedent to the novelty set forth in the "characterized by" clause. The novelty is meant to be particularly and distinctly recited in the "characterized by" clause whereas the antecedent recitations merely set forth the old and well-known combination in which the invention resides. These antecedent recitations should be interpreted to cover any combination in which the incentive novelty exercises its utility. In addition, the reference numerals in the claims are merely for convenience and are not to be read in any way as limiting.

What is claimed is:

1. A bending brake assembly for manually bending pieces of sheet metal material comprising:

a base defining a pocket;

a plurality of members supported by said base and each presenting opposing clamping surfaces for receiving the sheet metal material;

an extension extending away from said clamping surfaces;

a bending member movable between a pre-bending position, a first operating position, and a second operating position;

a socket connection supporting said bending member and including a male portion and a female portion each at least partially disposed in said pocket; and a finger extending from said male portion and defining a gap between said finger and said extension when in said pre-bending position with said finger maintaining said gap as said finger moves from said pre-bending position to said first operating position and said finger engaging said extension when in said second operating position.

2. A bending brake assembly as set forth in claim 1 wherein said male portion includes a distal end with said finger extending from said distal end such that said gap reduces size as said distal end and said finger move from said pre-bending position to said first operating position.

3. A bending brake assembly as set forth in claim 2 wherein said extension extends to a distal end surface for engaging said finger when in said second operating position.

4. A bending brake assembly as set forth in claim 3 wherein said finger includes an engagement surface configured to complement said distal end surface for maintaining engagement between said finger and said extension when in said second operating position.

5. A bending brake assembly as set forth in claim 2 wherein said base includes an inner surface defining said pocket for receiving said male portion, said distal end and said finger with said male portion, said distal end and said finger complementary in configuration to said inner surface such that said distal end and said finger abut said inner surface when in said pre-bending position for limiting movement of said male portion into said pocket with said distal end and said finger spaced from said inner surface when in said first and second operating positions.

6. A bending brake assembly as set forth in claim 5 wherein said finger and said distal end include an outer surface abutting said inner surface when in said pre-bending position with said outer surface spaced from said inner surface when in said first and second operating positions.

7. A bending brake assembly as set forth in claim 6 wherein said male portion presents an arcuate upper surface adjacent to said outer surface of said distal end and engaging said inner surface of said base when in said pre-bending position for guiding arcuate movement of said bending member as said male portion moves relative to said female portion.

8. A bending brake assembly as set forth in claim 1 including a bearing strip being sandwiched between said male portion and said female portion for facilitating relative movement between said male portion and said female portion.

9. A bending brake assembly as set forth in claim 8 including a first mechanical connection connecting said bearing strip to one of said male portion and said female portion.

10. A bending brake assembly as set forth in claim 9 wherein said first mechanical connection includes a projection and a recess for securing said bearing strip to one of said portions.

11. A bending brake assembly as set forth in claim 9 wherein said female portion and said male portion are arcuate and said bearing strip is arcuate and complementary to said portions.

12. A bending brake assembly as set forth in claim 1 wherein said members are further defined as generally c-shaped members presenting said opposing clamping surfaces.

13. A bending brake assembly as set forth in claim 1 wherein said male portion presents a slanted corner for bending the sheet metal material.

14. A bending brake assembly as set forth in claim 13 including a rubber strip secured to said slanted corner and abutting said extension when in said pre-bending position for preventing damage to the sheet metal material as said bending member moves between said first and second operating positions.

15. A bending brake assembly as set forth in claim 14 including a second mechanical connection connecting said rubber strip to said male portion.

16. A bending brake assembly as set forth in claim 15 wherein said second mechanical connection includes a protrusion and a nook for securing said rubber strip to said male portion.

17. A bending brake assembly for manually bending pieces of sheet metal material comprising:

a base;

a plurality of members supported by said base and each presenting opposing clamping surfaces for receiving the sheet metal material;

an extension extending away from said clamping surfaces;

a bending member movable between a pre-bending position, a first operating position, and a second operating position;

a male portion coupled to said bending member;

a female portion coupled to said base with said male portion movable relative to said female portion as said bending member moves between said pre-bending position, said first operating position and said second operating position; and a finger extending from said male portion and defining a gap between said finger and said extension when in said pre-bending position with said finger maintaining said gap as said finger moves from said pre-bending position to said first operating position and said finger engaging said extension when in said second operating position.

18. A bending brake assembly as set forth in claim 17 including a bearing strip being sandwiched between said male portion and said female portion for facilitating relative movement between said male portion and said female portion.

19. A bending brake assembly as set forth in claim 18 including a first mechanical connection connecting said bearing strip to one of said male portion and said female portion.

20. A bending brake assembly as set forth in claim 19 wherein said first mechanical connection includes a projection and a recess for securing said bearing strip to one of said portions.

21. A bending brake assembly as set forth in claim 18 wherein said female portion and said male portion are arcuate and said bearing strip is arcuate and complementary to said portions.

22. A bending brake assembly as set forth in claim 17 wherein said male portion presents a slanted corner for bending the sheet metal material.

23. A bending brake assembly as set forth in claim 22 including a rubber strip secured to said slanted corner and abutting said extension when in said pre-bending position for preventing damage to the sheet metal material as said bending member moves between said first and second operating positions.

24. A bending brake assembly as set forth in claim 23 including a second mechanical connection connecting said rubber strip to said male portion.

25. A bending brake assembly as set forth in claim 24 wherein said second mechanical connection includes a protrusion and a nook for securing said rubber strip to said male portion.

26. A bending brake assembly as set forth in claim 17 wherein said male portion includes a distal end with said finger extending from said distal end such that said gap reduces size as said distal end and said finger move from said pre-bending position to said first operating position.

27. A bending brake assembly as set forth in claim 17 wherein said extension extends to a distal end surface for engaging said finger when in said second operating position.

28. A bending brake assembly as set forth in claim 27 wherein said finger includes an engagement surface configured to complement said distal end surface for maintaining engagement between said finger and said extension when in said second operating position.

29. A bending brake assembly for manually bending pieces of sheet metal material comprising:

a base;

a plurality of members supported by said base and each presenting opposing clamping surfaces;

an extension extending away from said clamping surfaces;

a bending member movable between a pre-bending position, a first operating position, and a second operating position;

a socket connection supporting said bending member and including a male portion and a female portion with said male portion movable relative to said female portion as said bending member moves between said pre-bending position, said first operating position and said second operating position; and a finger extending from said male portion and defining a gap between said finger and said extension when in said pre-bending position with said finger maintaining said gap as said finger moves from said pre-bending position to said first operating position and said finger engaging said extension when in said second operating position.

30. A bending brake assembly as set forth in claim 29 including a bearing strip being sandwiched between said male portion and said female portion for facilitating relative movement between said male portion and said female portion.

31. A bending brake assembly as set forth in claim 30 including a first mechanical connection connecting said bearing strip to one of said male portion and said female portion.

32. A bending brake assembly as set forth in claim 31 wherein said first mechanical connection includes a projection and a recess for securing said bearing strip to one of said portions.

33. A bending brake assembly as set forth in claim 30 wherein said female portion and said male portion are arcuate and said bearing strip is arcuate and complementary to said portions.

34. A bending brake assembly as set forth in claim 29 wherein said male portion presents a slanted corner for bending the sheet metal material.

35. A bending brake assembly as set forth in claim 34 including a rubber strip secured to said slanted corner and abutting said extension when in said pre-bending position for preventing damage to the sheet metal material as said bending member moves between said first and second operating positions.

36. A bending brake assembly as set forth in claim 35 including a second mechanical connection connecting said rubber strip to said male portion.

37. A bending brake assembly as set forth in claim 36 wherein said second mechanical connection includes a protrusion and a nook for securing said rubber strip to said male portion.

38. A bending brake assembly as set forth in claim 29 wherein said male portion includes a distal end with said finger extending from said distal end such that said gap reduces size as said distal end and said finger move from said pre-bending position to said first operating position.

39. A bending brake assembly as set forth in claim 29 wherein said extension extends to a distal end surface for engaging said finger when in said second operating position.

40. A bending brake assembly as set forth in claim 39 wherein said finger includes an engagement surface configured to complement said distal end surface for maintaining engagement between said finger and said extension when in said second operating position.

* * * * *